United States Patent [19]

Reissig

[11] Patent Number: 4,525,958

[45] Date of Patent: Jul. 2, 1985

[54] METHOD OF CONTROLLING ARTICLE SPEED DURING EDGE GRINDING

[75] Inventor: George W. Reissig, Sarver, Pa.

[73] Assignee: PPG Industries, Inc., Pittsburgh, Pa.

[21] Appl. No.: 581,744

[22] Filed: Feb. 21, 1984

Related U.S. Application Data

[63] Continuation of Ser. No. 322,786, Nov. 19, 1981, abandoned.

[51] Int. Cl.[3] ..... B24B 9/10

[52] U.S. Cl. ..... 51/283 E; 51/97 NC; 51/101 R; 51/105 EC; 51/165.92; 409/148; 409/154

[58] Field of Search ..... 51/97 NC, 101 R, 101 LG, 51/105 EC, 105 LG, 165.77, 165.78, 165.79, 165.8, 165.89, 283 E, 284 E, 165.92, DIG. 32; 409/148, 154, 123

[56] References Cited

U.S. PATENT DOCUMENTS

| | | | |
|---|---|---|---|
| 2,129,049 | 9/1938 | Doran | 409/148 |
| 3,220,315 | 11/1965 | Mathias | 409/148 |
| 3,545,140 | 12/1970 | Jones | 51/170 PT |
| 3,748,789 | 7/1973 | Wada et al. | 51/165.8 |
| 3,803,772 | 4/1974 | Klar | 51/165.76 X |

FOREIGN PATENT DOCUMENTS

| | | | |
|---|---|---|---|
| 2817397 | 10/1978 | Fed. Rep. of Germany | 51/101 R |

*Primary Examiner*—Robert P. Olszewski
*Attorney, Agent, or Firm*—Donald Carl Lepiane

[57] ABSTRACT

An edge grinder includes a shaft for supporting a glass sheet template in spaced relationship to one another. The template and glass sheet are rotated about a sheet axis of rotation and a grinding wheel is rotated about a wheel axis of rotation. The grinding wheel and a template follower spaced from the grinding wheel are biased against the glass sheet and template respectively, to shape the glass sheet to a desired contour as defined by the template. As the grinding wheel engages varying edge damage and/or increased peripheral rotational speed of the sheet, the load on the motor powering the grinding wheel varies as indicated by current input to the grinding wheel motor. Variations in the current input are responded to by selectively varying the rotational speed of the sheet. In this manner, a uniform rate of material removal is maintained to eliminate overheating of the glass edge and grinding wheel during shaping of the glass sheet.

3 Claims, 4 Drawing Figures

METHOD OF CONTROLLING ARTICLE SPEED DURING EDGE GRINDING

This is a continuation of application Ser. No. 322,786, filed Nov. 19, 1981, now abandoned.

BACKGROUND OF THE INVENTION

1. Field of the Invention

This invention relates to a glass edge grinding machine, and more particularly, to a device for selectively controlling peripheral speed of a rotating glass panel during grinding and/or seaming of panel edge portions.

2. Discussion of the Technical Problems

In shaping peripheral edge portions of glass panels, for example, glass panels used for automotive and home windows and for mirrors, the panels are chucked up and rotated about an article center of rotation. One or more grinding wheels powered to rotate about its or their center of rotation(s) is (are) moved into engagement with peripheral edge portions of the glass panel to shape, e.g., grind and/or seam same. Edge grinding machines that operate in a manner similar to that discussed above are taught in the following.

U.S. Pat. Nos: 2,579,337; 3,525,182; 2,597,180; 3,574,976; 2,826,872; 3,621,619; 2,883,800; 3,626,842; 2,906,065; 3,641,711; 2,969,624; 3,827,189; 2,995,876; 4,060,937; 3,274,736; 4,081,927.

In general, the rate of material removal from the panel periphery is selected to prevent "burning" of the glass panel edges which, in severe cases, can result in edge chipping while minimizing the time required for shaping the periphery of the glass panel. Factors that control peripheral material removal rate include rotational speed of the shaping wheel, rotational and peripheral speed of the glass panel, glass panel thickness, grit size of the shaping wheel, biasing force urging the shaping wheel and glass panel edge portions toward one another, peripheral edge configuration of the glass panel and peripheral edge damage of the panel. Usually the shaping wheel speed and characteristics are constant. Of particular interest, therefore, in the following discussion is the effect peripheral edge damage and peripheral configuration of the glass panel have on material removal rate. If the glass panel is symmetrical around its axis of rotation and the peripheral edge damage is essentially uniform, the peripheral edge portions of the glass panel can be shaped using a constant shaping wheel speed and a constant glass panel rotational speed. This is because a symmetrical panel has a constant radius and, therefore, a constant peripheral speed at a constant rotational panel speed and uniform peripheral edge damage has uniform resistance to the removal of material by the shaping wheel. In view of the foregoing, the rotational speeds of the shaping wheel and panel are selected to maximize material removal rate while preventing burning of the panel edges.

Consider now a glass panel that is unsymmetrical around its axis of rotation but has uniform edge damage. In this instance, the peripheral speed of the work plate varies during a cycle of rotation. For example, s the radius of the glass panel, e.g., the distace between the edge portion being ground and the rotational axis of the glass panel increases, the higher the peripheral speed of the glass panel even though the rotation at the center of the glass panel is constant. Since the peripheral speed of the panel varies, an optimum constant material removal rate cannot be attained. This is because selecting a panel speed for material removal rate that prevents burning of the panel edges at the longer radii is usually too slow a panel speed at the shorter radii. On the other hand, a panel speed for optimum material removal rate at the shorter radii usually causes burning of the panel edges at the longer radii. To compensate for unsymmetrical work pieces, the center rotational speed of the panel is varied as the panel passes through consecutive angular increments of rotation. One technique accomplishes this by mounting tripping devices on the outer surface of the rotating shaft supporting the glass panel. The devices are adjusted to control the shaft rotational speed as a function of their corresponding radius, i.e., the distance between the panel axis of rotation and peripheral edge being shaped. In this manner, the rotational speed of the glass panel is varied to vary the peripheral speed of the panel to obtain a substantially constant material removal rate. Techniques similar to the preceding are taught in U.S. Pat. Nos. 3,274,376 and 2,579,337. Although these techniques are acceptable, there are limitations. For example, adjustment of devices for controlling shaft speed requires a new setup for each panel design change. This is time consuming and limits output.

When the glass panel is symmetrical and there is non-uniform peripheral edge damage, e.g., the presence and absence of flares and/or chips at glass panel edge portions and/or varying amounts of material to be removed to attain the desired panel shape, the following problems are usually encountered. The grinding wheel is biased to remove more material at a given time period which puts an extra load on the motor driving the shaping or grinding wheel. If the grinding motor is powered to remove the flared and/or chipped edge portion at a uniform rate, the motor drives the grinding wheel at an increased material removal rate at a chip and/or flare free edge portion. This increased wheel speed can result in burning of the panel edges. In the alternative, if the grinding wheel is powered to remove material from a flare and/or chip free portion, there is increased resistance to material removal at the flared or chipped edge portion. This resistance usually causes the grinding wheel to overheat and can result in damaging the grinding wheel.

Techniques practiced in combination with industrial robots are available for removing material from edges having non-uniform peripheral edge damage and varying amounts of material to be removed for a desired panel configuration. One technique measures the current input to the grinding motor. An increase in current indicates an additional load on the grinding wheel which can be interpreted as a decrease in material removal rate due to increased edge damage. When current increase is sensed, the robot is programmed to move away from the panel edge to take a smaller material bite, thereby decreasing the resistance acting on the wheel and the load on the motor. Although the technique of taking smaller bites of material is acceptable, it requires more workpiece rotation cycles to shape a glass panel to the desired peripheral configuration.

From the above discussion, it can now be appreciated that it would be advantageous to provide a technique for shaping a glass panel that does not have the limitation of the presently available material removal technique.

SUMMARY OF THE INVENTION

This invention relates to a method of shaping peripheral edge portions of an article, e.g., a glass panel or sheet. The method includes the steps of biasing shaping facilities, e.g., a grinding or seaming wheel against the peripheral edges of the glass sheet. The shaping facilities are rotated about a shaping axis of rotation and the article is rotated about an article axis of rotation. The shaping facilities and article are displaced relative to one another to vary the distance between their respective axis of rotation according to a schedule to shape the peripheral edge portion of the article to a desired peripheral configuration. The improvement includes the steps of monitoring power input, e.g., current input to the shaping facilities and selectively altering the rotational speed of the article as a function of the current input. For example, as the value of the current input increases, the article rotational speed decreases, and vice versa, to provide a substantially uniform rate of material removal by the shaping facilities.

This invention also relates to an apparatus for performing the above method and includes shaping facilities, for example, a grinding or seaming wheel rotated about a shaping axis of rotation. An article support facility is rotated about an article axis of rotation. The shaping facilities and support facilities are displaced relative to one another to vary the spaced distance between their axis of rotation according to a schedule to shape the peripheral edge portions of the article to a desired peripheral configuration. The improvement includes facilities for monitoring power input, e.g., current input to the shaping facilities and facilities acting on the article rotating facilities in response to the monitoring facilities for selectively varying the rotational speed of the article support facilities.

The instant invention eliminates the problems associated with the presently available edge grinding apparatus. More particularly, as the grinding wheel rotates and encounters excessive edge damage, and/or increasing radii, a load is put on the grinding wheel to remove material at a greater rate than at undamaged edges or decreasing radii. This additional load is measured by the increase in current input to the motor. When an increase in current input to the motor is sensed, the article rotational speed is decreased thereby decreasing the peripheral speed of the article. In this manner, the material removal rate remains relatively constant while preventing overheating of the grinding wheel and/or burning of the article edges while minimizing the article shaping time. Further, by providing a uniform rate of material removal one cycle of rotation of the article can be used to provide an article having the desired peripheral configuration.

DETAILED DESCRIPTION OF THE INVENTION

The instant invention is practiced on edge grinders which rotate an article, e.g., a glass sheet or panel about an article axis of rotation and a shaping wheel about a shaping or wheel axis of rotation while biasing the shaping wheel and article toward one another. Edge grinders of the above type are taught in U.S. Pat. Nos. 2,883,800; 2,906,065 and 4,081,927 which teachings are hereby incorporated by reference.

Figure 1:
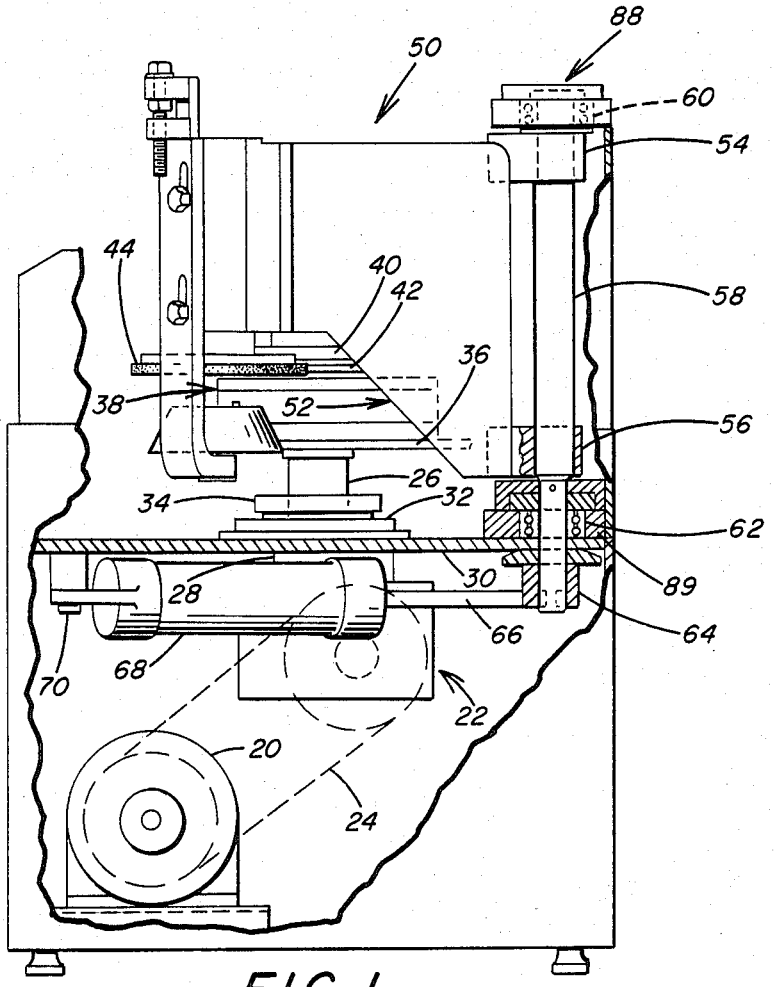
FIG. 1 is a side elevated view having parts broken away for purposes of clarity of a sheet edge grinding apparatus that may be used in the practice of the invention.

The following is a general discussion of an edge grinder that is used in the practice of the invention, and reference may be had to the above-mentioned patents, in particular to U.S. Pat. No. 2,906,065 for a more detailed discussion. With reference to FIG. 1, motor 20 drives reducer 22 by way of drive belt 24. The reducer 22, in turn, drives shaft 26 that extends vertically through a pair of ball bearings (not shown) mounted in a support column 28 carried by main table 30. The shaft 26 which extends upwardly through a stationary collar 32 has a rotating cap 34 fixed thereto. The cap 34 overlies the collar 32 to prevent the flow of grinding fluid or movement of particles down the shaft surface. A template 36 is secured to the shaft 26 to rotate therewith. Mounted above the template 36 on the upper end of the shaft 26 is a sheet support and position device 38. A sheet holding device 40 secures a sheet 42 (see also FIG. 3) on the support and positioning device 38 to rotate the sheet 42 by way of the shaft 26 relative to shaping wheel 44, e.g., a grinding wheel or seaming wheel.

Grinding mechanism 50 of the edge grinder includes a wing 52 swingingly mounted by upper and lower ears 54 and 56, respectively, from a vertical rocking shaft 58 which is, in turn, mounted and supported by bearings 60 and 62. The lower end of the shaft 58 extends beneath the table 30 and is fixed to crank arm 64. The crank arm 64 is pivotally connected to end of piston rod 66 of ram 68. The ram 68 is swingingly mounted on the lower end of boss 70 depending from underside of the main table 30.

Figure 2:
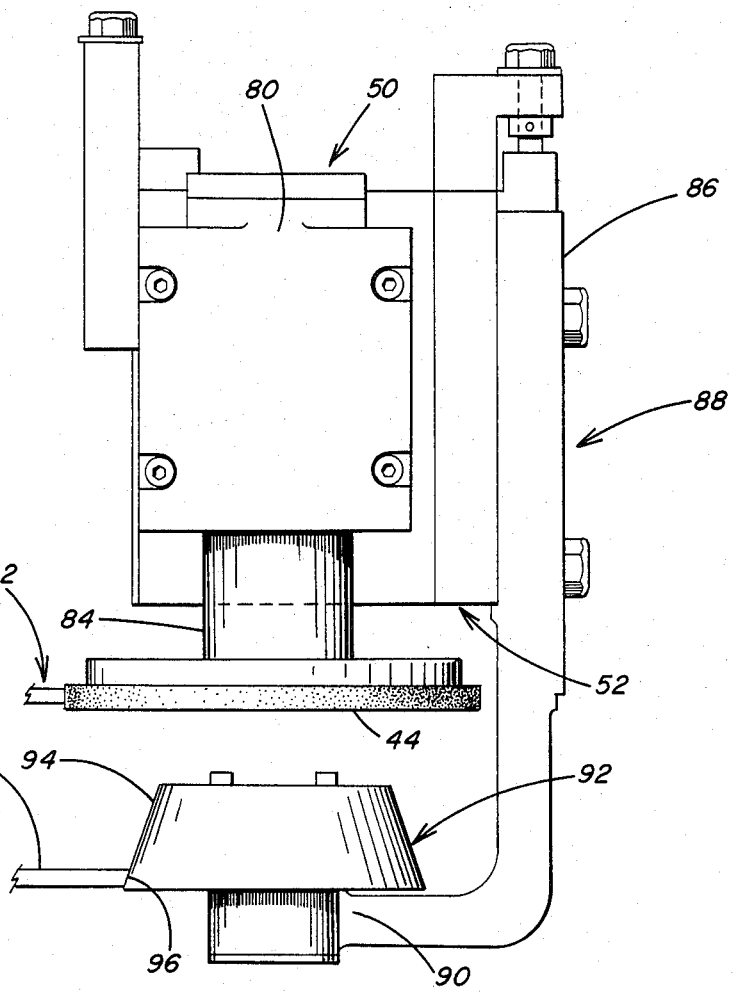
FIG. 2 is a fragmented side elevated view on an enlarged scale illustrating a template follower and grinding wheel of the apparatus shown in FIG. 1.

Referring now to FIGS. 1 and 2, as required, the wing 50 carries a drive motor 80 which has the shaping wheel 44 secured to its shaft 84 to rotate the wheel 44 about the shaping axis of rotation. With specific reference to FIG. 2, the motor 80 is mounted on long leg 86 of adjustable "L" shaped member 88. Rotatably mounted on short leg 90 of the "L" shaped member 88 is a template follower 92 having a frusto-conical periphery 94 which rides on periphery 96 of the template 36. The template follower 92 freely rotates about its axis of rotation which is coincident with the axis of rotation of the shaping wheel 44. In this manner, as the template follower 92 rides on the template periphery 96, the shaping wheel selectively moves toward and away from the article axis of rotation according to a schedule, i.e., the template periphery 96 to shape the article periphery to a desired contour.

Taught in U.S. patent application Ser. No. 271,064, filed in the name of David A. Mayer on June 8, 1981, for Automatic Edge Grinder, assigned to the assignee of the instant application, is a template follower and grinding wheel arrangement that may also be used in the practice of the invention. The teachings of the above-mentioned U.S. patent application are hereby incorporated by reference.

Figure 3:
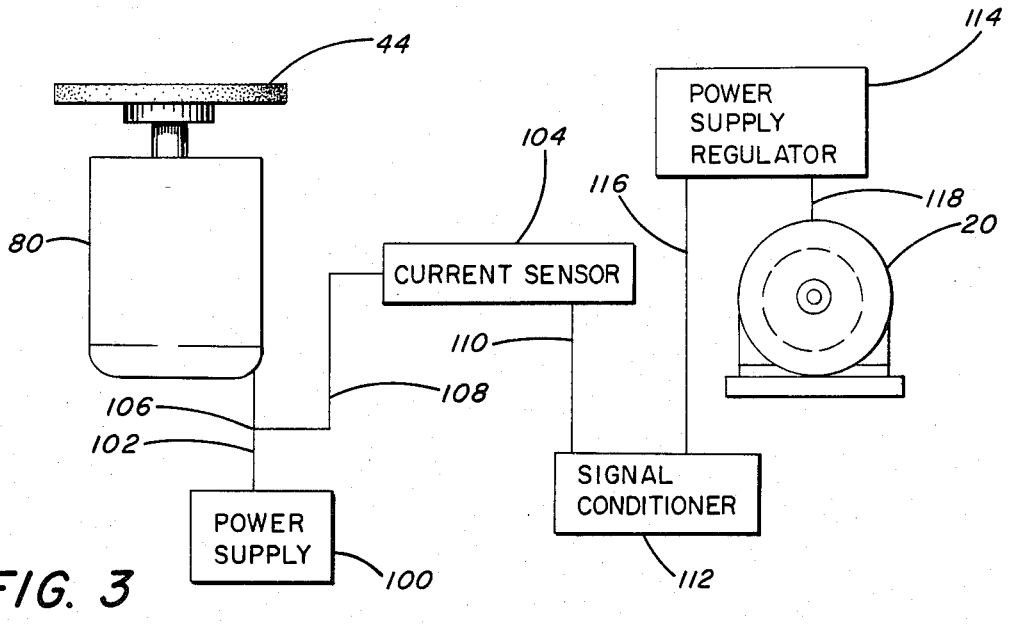
FIG. 3 is a schematic showing electrical components and their connection to selected elements of the apparatus shown in FIG. 1 in accordance with the teachings of the invention.

With reference to FIG. 3, the discussion is directed to the instant invention for controlling the rotation of the support column 28 for a uniform removal rate of material from the peripheral edges of the glass panel 42. The motor 80 for powering the grinding wheel 44 is connected to power supply 100 by cable 102. A current sensor 104, e.g., of the type sold by F. W. Bell, Inc., as a Hall Effect Current Transducer Sensor R2000 is connected to the cable 102 at 106 by cable 108. The current sensor monitors the current input to the motor 80. When a load is on the motor 80, e.g., the grinding wheel 44 encounters increased grinding resistance, the current sensor 104 senses an increase in current input to the motor and forwards a signal, e.g., a first signal value along cable 110 to signal conditioner 112. Conversely, if the load on the motor decreases, the current sensor 104 senses a decrease in the current input to the motor 80 and forwards a different signal, e.g., a second signal value along the cable 110 to the signal conditioner 112. If the current sensor 104 senses no change in the current input to the motor 80, there is no change in the signal value to the signal conditioner. The signal conditioner 112, e.g., of the type sold by Acromag, Inc., as a millivolt transmitter, conditions the received signal for subsequent use in power supply regulator 114 connected to the signal conditioner 112 by cable 116. The power supply regulator 114 in response to the conditioned signal from the signal conditioner 112 controls the power input along cable 118 to the motor 20 which drives the shaft 26 and the glass panel secured thereto at a selected rotational speed to provide a uniform rate of material removal.

Figure 4:
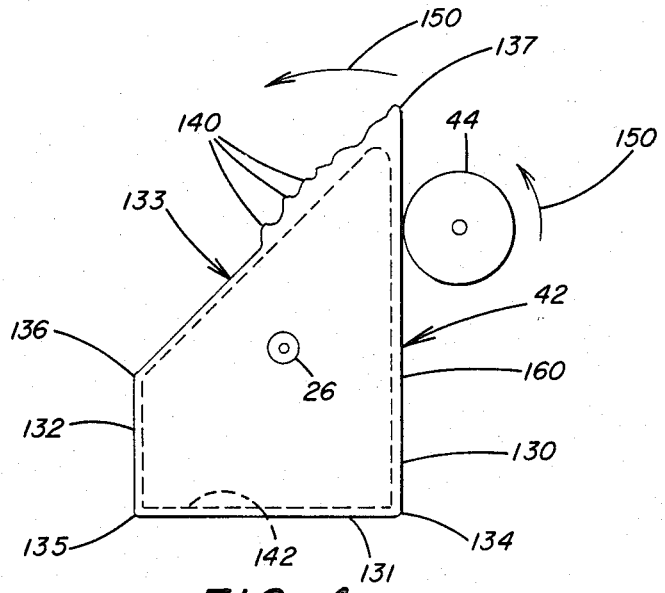
FIG. 4 is a plan elevated view of a glass panel to be shaped in accordance to the teachings of the invention to the configuration illustrated by dotted lines.

With reference to FIG. 4, there is shown unsymmetrical glass panel 42 which may not necessarily be of a shape on which the invention is practiced, but has peripheral edge portions illustrated for ease of appreciating and understanding the invention. In general, the glass panel has sides 130–133 and corners 134–137 in an as-cut condition. The sides 130, 131 and 132 are shown to have relatively smooth peripheral edge portions indicating uniform peripheral edge damage. The panel side 133 has peripheral edge portions having uniform edge damage and peripheral edge portions have non-uniform peripheral edge damage, e.g., flared designated by numeral 140. Within the panel 42 is a dotted line 142 illustrating the desired peripheral configuration of the shaped piece. In comparing the final shaped piece designated by 142 to the as-cut piece, it is noted that more material is to be removed from the panel corner 137 than panel corners 14 and 135 and from the edge portions 140 than the remaining edge portions.

A template 36 having a peripheral configuration corresponding to the final shaped piece designated by the numeral 142 is secured on the shaft 26. The glass panel 42 is conveniently secured on the sheet support and position device 38 by sheet holding device 40. The motor 20 is energized to rotate the glass panel about a shaping axis of rotation in the direction of the arrow 150 shown in FIG. 4 at a speed of about 1 revolution per minute, and the motor 80 is energized to rotate the grinding wheel 44 in the direction of the arrow 152 shown in FIG. 4 at a speed of about 3600 revolutions per minute. A current range is preset in the current sensor, e.g., 4 to 7 amps, which maximizes material removal while preventing damage to the grinding wheel and glass panel edges. The ram 68 is energized to bias the template follower 92 toward the template periphery 96 and the rotating grinding wheel 44 against peripheral edge portions of the glass panel 42 as coolinng fluid is conveniently flowed over between the grinding wheel 44 and panel edge portions to prevent overheating of the panel edges and grinding wheel.

The position of the grinding wheel 44 relative to the panel axis of rotation at the start of the grinding cycle is as shown in FIG. 4. As the panel 42 rotates in the direction 150, the distance between the wheel axis of rotation and article axis of rotation decreases and the peripheral rotational speed of the panel initially decreases. The grinding wheel rotates more freely and this is indicated by a load decrease on the motor, i.e., the motor 80 draws less current as sensed by the current sensor 104. The current sensor 104 forwards a signal when the current sensed is below the preset value in the current sensor through the signal conditioner 112 to the power supply regulator 114 to increase the rotational speed of the panel thereby increasing the resistance to the grinding wheel which results in increased current input to the motor 80. As the grinding wheel moves beyond the position designated as 160, the radius increases which increases the peripheral speed of the panel. The increased peripheral panel speed increases the resistance to the grinding wheel 44 which results in the motor 80 drawing more current, i.e., the load on the motor increases. The current sensor 104 senses a current increase to the motor 80 and forwards a signal to the power supply regulator 114 to decrease the speed of the motor 20 to decrease the rotational speed of the panel until the current as monitored by the current sensor 104 is within the predetermined range thereby maintaining a uniform rate of material removal.

As the grinding wheel 44 moves over the corner 134, there is a greater amount of material to be removed than at the side 130. Removing the extra material in addition to increasing the radius puts a load on the motor 80 and accordingly, the rotational speed of the motor 20 is decreased until the current sensor 104 senses that the current input to the motor 80 is in the preferred range. The preceding is repeated for the sides 131 and 132 as well as corners 135 and 136.

When the grinding wheel 44 moves against the flares 140 at the panel side 133, the grinding wheel 44 encounters a greater resistance which increases the load on the motor 80 in order to remove the additional material to provide the desired shape as shown by dotted lines 142. The additional load on the motor results in an increase of current input to the motor 80 and corresponding in accordance to the teachings of the invention, the panel rotational speed is decreased to provide for a uniform rate of material removal. The grinding wheel 42, as it advances over the corner 173, has more material to remove than at corners 134–136 or sides 130–132. This additional material removal puts an additional load on grinding motor 80 and, as previously discussed, requires a decrease in the panel rotational speed for a uniform material removal rate.

As can now be appreciated, the invention is not limited to the above example which is presented for illustration purposes only. Further, the invention may be practiced on materials other than glass, e.g., ceramics, glass-ceramics, ferrous materials and non-ferrous material.

After the panel 42 is ground to shape, it may be bent as taught in U.S. Pat. No. 4,082,530, and/or tempered as taught in U.S. Pat. Nos. 4,076,511 and 4,119,426, or two panels laminated together as taught in U.S. Pat. No. 4,046,951 for vehicle windows. The teachings of the above-mentioned patents are hereby incorporated by reference.

What is claimed is:

1. A method of shaping peripheral edge portions of a glass sheet to provide a sheet having a non circular peripheral configuration, comprising the steps of:

rotating the glass sheet about a sheet axis of rotation;

rotating shaping means about a shaping axis of rotation;

measuring current input to the shaping means;

biaising peripheral edge portions of the sheet and shaping means toward one another to shape peripheral edge portions of the sheet to provide the sheet with the non-circular peripheral configuration, wherein the peripheral speed of the sheet as it moves past the shaping means (1) increases as the spaced distance between the sheet axis of rotation and shaping axis of rotation increases, resulting in an increase in the measured current input to the shaping means, and (2) decreases as the spaced distance between the sheet axis of rotation and shaping axis of rotation decreases, resulting in a decrease in the measured current input to the shaping means;

monitoring the measured current input; and altering rotational speed of the glass sheet as a function of said monitoring step, wherein the rotational speed of the sheet is decreased to decrease the peripheral speed of the sheet in response to the increase in the measured current input, and the rotational speed of the sheet is increased to increase the peripheral speed of the sheet in response to the decrease in the measured current input.

2. The method as set forth in claim 1 wherein the shaping means is a grinding wheel.

3. The method as set forth in claim 1 wherein the shaping means is a seaming wheel.

* * * * *